United States Patent [19]

Rasmussen et al.

[11] Patent Number: 4,710,146

[45] Date of Patent: Dec. 1, 1987

[54] PROJECTILE PROPELLING ATTACHMENT FOR TOY FIGURES

[75] Inventors: Russell G. Rasmussen, Skokie; Leonard J. Stubenfoll, Chicago; Harry Disko, South Barrington, all of Ill.

[73] Assignee: Marvin Glass & Associates, Chicago, Ill.

[21] Appl. No.: 827,245

[22] Filed: Feb. 6, 1986

[51] Int. Cl.[4] ..... A63H 13/10; A63H 33/30

[52] U.S. Cl. ..... 446/308; 446/473; 124/16

[58] Field of Search ..... 446/308, 473, 40, 41, 446/45, 51, 54, 64, 65, 268, 309, 310, 361, 362, 298, 306, 390, 435, 429, 407; 124/16, 17, 21, 62, 63, 64, 65; 42/52, 53, 54

[56] References Cited

U.S. PATENT DOCUMENTS

| | | | |
|---|---|---|---|
| 553,830 | 2/1896 | Bolton | 446/308 |
| 731,825 | 6/1903 | Voorhees | 446/336 X |
| 1,062,129 | 5/1913 | Sweeney | 446/310 |
| 1,149,698 | 8/1915 | Spencer | 124/65 |
| 2,422,913 | 6/1947 | Leach | 446/310 |
| 2,853,990 | 9/1958 | Haley | 446/309 X |
| 2,994,155 | 8/1961 | Parker | 446/40 |
| 3,037,320 | 6/1962 | Powell | 446/473 |
| 3,172,401 | 3/1965 | Pullen | 446/308 X |
| 3,412,998 | 11/1968 | Lott et al. | 446/268 X |
| 3,634,964 | 1/1972 | Nail | 446/473 |
| 3,955,312 | 5/1976 | Pugh | 446/390 X |
| 4,569,666 | 2/1986 | Wolf | 446/473 X |
| 4,585,426 | 4/1986 | Rasmussen et al. | 446/428 |
| 4,626,222 | 12/1986 | Sweet | 446/268 |

FOREIGN PATENT DOCUMENTS

| | | | |
|---|---|---|---|
| 282254 | 10/1934 | Italy | 446/473 |
| 5781 | of 1915 | United Kingdom | 446/308 |

*Primary Examiner*—Robert A. Hafer
*Assistant Examiner*—D. N. Muir
*Attorney, Agent, or Firm*—John S. Pacocha

[57] ABSTRACT

Projectile propelling attachments are provided for toy figures that have an arm connected at the shoulder end for pivotal movement relative to the torso through approximately ninety degrees. The attachments include an apparatus releasably mountable on the figure in engagement with the arm. A front end bore receives a projectile from which a tether extends out the back end of the apparatus through a smaller diameter bore. In the larger diameter bore there is a coil compression spring. At the free end of the tether a retainer prevents the tether passing back through the apparatus. In one form, the back end of the tether is attached to a reel carried on the back of the figure. Pulling on the tether pivots the arm to the firing position and then compresses the spring. When the tether is released, the spring propels the projectile.

9 Claims, 13 Drawing Figures

PROJECTILE PROPELLING ATTACHMENT FOR TOY FIGURES

BACKGROUND OF THE INVENTION

1. Field of the Invention

This invention relates to toy figures and more particularly to weapon attachments for toy figures.

2. Background Art

Toy action figures and weapons for such toy figures are popular toys. U.S. Pat. No. 3,425,153 issued Feb. 4, 1969 to Bonanno, et al. discloses a torsion spring biased spindle within the torso of a body urging an arm toward an extreme position so that the arm may be pulled back against the bias and then released to throw a grenade. The toy figure disclosed in U.S. Pat. No. 4,118,888 issued Oct. 10, 1978 to Ogawa has an arm appendage including a spring loaded firing mechanism capable of discharging the first portion of the arm as a projectile. Toy figures having a pivotal arm carrying a weapon are shown in the U.S. Pats. Nos. 3,082,573 issued Mar. 26, 1963 to Kantz; 3,452,472 issued July 1, 1969 to Meyer, et al.; 3,947,994 issued Apr. 6, 1976 to Meyer, et al.; and 4,182,075 issued Jan. 8, 1980 to James. However, there remains a need for attachments for toy figures that can propel a projectile.

SUMMARY OF THE INVENTION

The present invention is concerned with providing a projectile propelling attachment for toy figures. This and other objects and advantages of the invention are achieved by providing an attachment for a toy figure that has an arm mounted for pivotal movement relative to the torso, through approximately ninety degrees, with an attachable apparatus that includes a spring for propelling a projectile. A tether is attached at one end to the projectile and extends through the spring and the weapon out of the back end of the weapon which is attachable to the figure in engagement with the arm. At the back of the tether a retainer is added to prevent the tether passing through the weapon. In one form, the back end of the tether is attached to a reel carried by the figure. With the projectile in the weapon apparatus, pulling on the rearward end of the tether moves the arm to the firing position, further pulling on the tether contracts the spring so that upon release of the tether the projectile is propelled forwardly to the extent of the tether. When the apparatus is moved to the firing position, a projection engages part of the toy figure to limit further movement of the apparatus.

BRIEF DESCRIPTION OF THE DRAWINGS

For a better understanding of the present invention reference may be had to the accompanying drawings in which.

DETAILED DESCRIPTION OF THE PREFERRED EMBODIMENT

Figure 1:
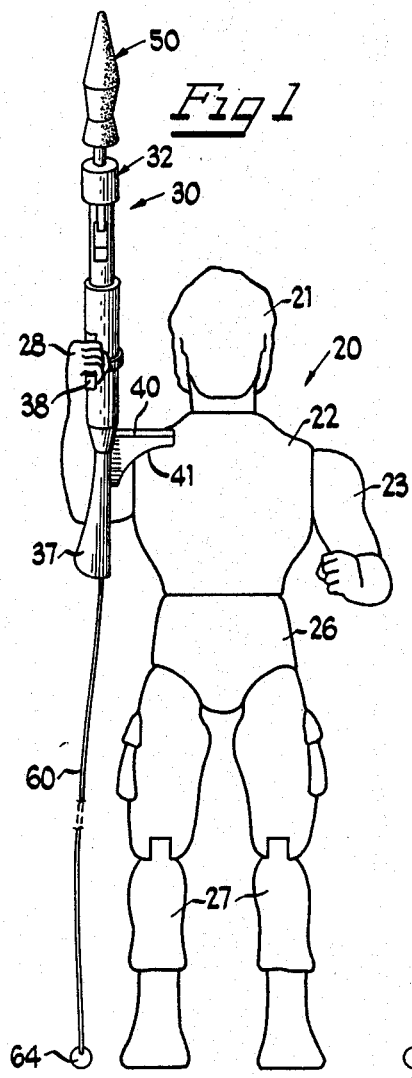
FIG. 1 is a front elevational view of an embodiment of the present invention.

Referring now to the drawings in which like parts are designated by like reference numerals throughout the several views, FIG. 1 shows a toy figure or character 20. The figure has a head 21 mounted atop a torso 22 to which arms 23 and 24 are attached. Head 21 may be mounted for rotation about a generally vertical axis relative to upper torso 22, which in turn may be connected to a lower trunk 26 for rotation in the area of the waist about a generally vertical axis. A pair of legs 27 may be mounted to lower trunk 26 for articulation at the hip and/or the knee joints by methods that are known in the toy figure art and need not be disclosed in this application.

At least arm 24 is formed with a hand 28 in a handle grasping position. Arm 24 is attached for pivotal or rotational movement, relative to the torso 22, about a shaft 29. Alternatively, both arms may be mounted for movement on shaft 29, or each arm may be mounted on a separate shaft that is generally coaxial with the other shaft in any one of a number of conventional methods known in the toy figure art. For the purposes of this invention, arm 24 should pivot about ninety degrees from a position generally like that illustrated in FIG. 2 to the position illustrated in FIG. 3.

Fitted for attachment to FIG. 20 is a projectile propelling attachment 30 which includes a weapon or apparatus styled as a grenade or rocket launcher 32. The weapon is formed of molded parts 33 and 34 mating generally along a plane extending between a front firing end 35 and a back end 36. Adjacent the back end, parts 33 and 34 form a stock 37 that is received between torso 22 and arm 24, beneath the pivotal connection of the arm to the torso. Spaced from back end 36 is a downwardly depending handle 38 of a size and shape to fit within the grasping hand 28 of the figure. Between the back end 36 and handle 38, is a projection 40 that extends laterally away from stock 37, generally transverse to the depending handle 38. Projection 40 includes a rearwardly disposed, curved surface 41 adapted to abut a portion of the body of toy FIG. 20 when arm 24 holding weapon 32 is in the firing position illustrated in FIG. 3.

From the front firing end 35, a bore 42 extends part way into weapon 32. Continuing from the inside end of blind bore 42, through to the back 36 of the weapon, is a bore 44 of a substantially smaller diameter than bore 42. Inside of bore 42 is a coil compression spring 46 having an outer diameter throughout most of the length of the spring that is less than the diameter of bore 42.

However, the end of the spring adjacent the inside end of bore 42 has an enlarged outer diameter, generally equal to the diameter of bore 42, so that the spring is retained by friction within the bore. To further secure spring 46 within bore 42, a projecting end 47 of the wire forming spring 46 is anchored within one of the mating parts.

Attachment 30 includes a projectile 50 having a front nose section 52. The nose, which is preferably formed of a relatively soft deformable foam, soft vinyl, or other suitable material, is anchored to a more rigid shaft 54. So that the shaft can fit into bore 42, the outer diameter of the shaft is smaller than the diameter of bore 42. However, shaft 54 is of a large enough diameter so that the shaft does not fit within the inside diameter of coil compression spring 46. Extending through the length of shaft 54 is a hole 55 of a diameter approximately the same as that of small bore 44 in weapon 32.

Figure 5:
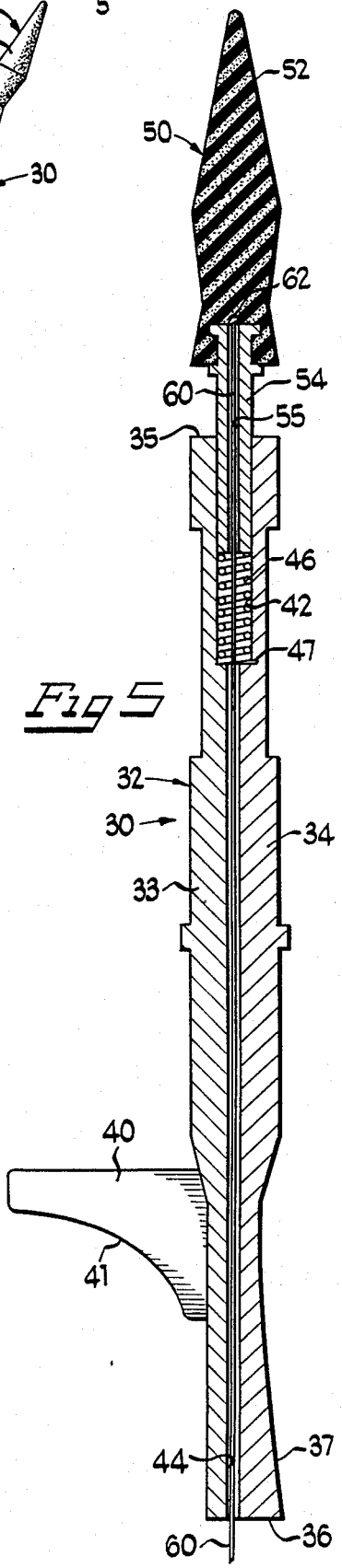
FIG. 5 is an enlarged sectional view taken generally along line 5—5 of FIG. 2.

A flexible tether 60, such as string, is secured at one end 62 to projectile 50. As illustrated in FIG. 5, the one end of tether 60 passes through hole 55, is knotted at 62 and is then covered by nose 52. The other end of tether 60 extends through the inside diameter of coil spring 46 and small bore 44 out the back end 36 of the weapon. At the back end of tether 60, a retainer, in the form of a small bead 64, is attached. Bead 64 is large enough so that it will not pass through bore 44 in the back end of the weapon.

Figure 2:
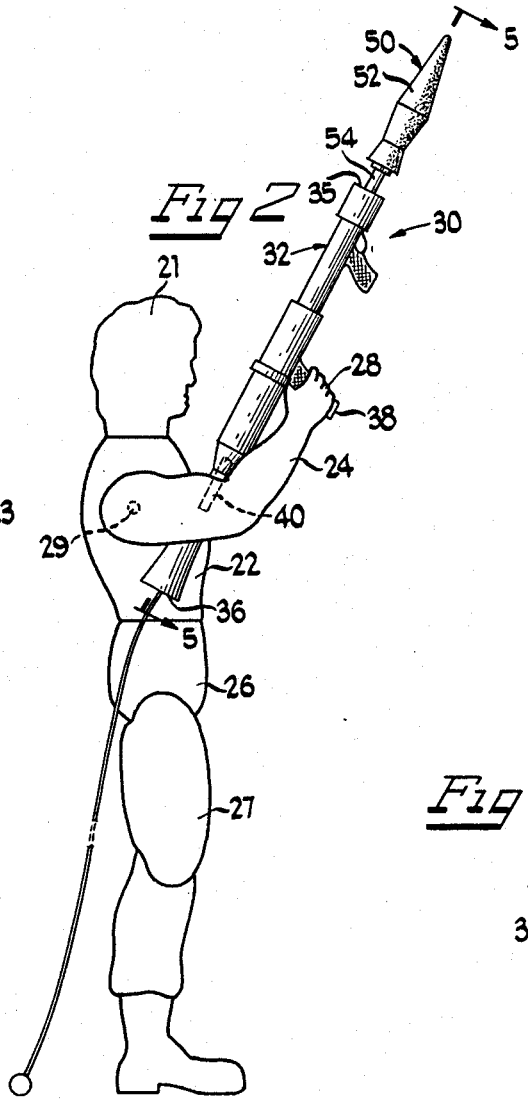
FIG. 2 is a side elevational view.
Figure 3:
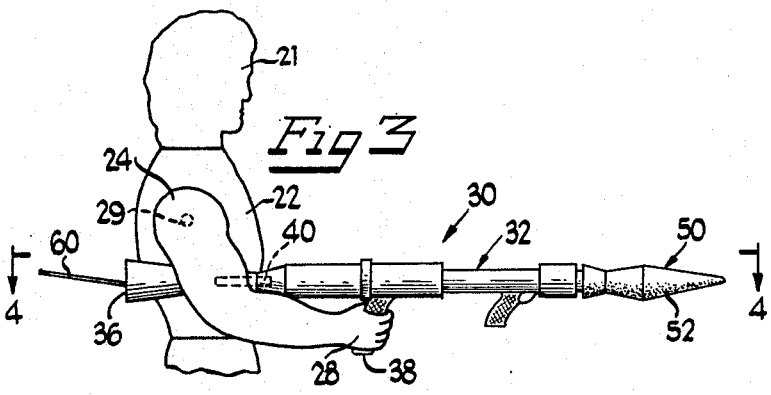
FIG. 3 is a partial side elevational view of the embodiment shown in FIGS. 1 and 2 with the projectile propelling attachment moved down to a firing position.
Figure 4:
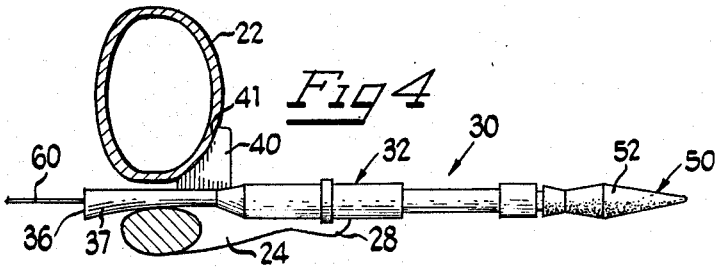
FIG. 4 is a sectional view taken generally along line 4—4 of FIG. 3.

In play, after releasably mounting attachment 30 on FIG. 20, in a position as illustrated in FIGS. 1 and 2, the child pulls the back end of tether 60. Initially, pulling on tether 60 will first seat the projectile 50 in bore 42 to arm weapon 32. Additional pulling brings apparatus 30 down from the raised position of FIGS. 1 and 2, approximately ninety degrees, to the firing position illustrated in FIG. 3.

Once the attachment is in the firing position, further pulling on the rearward end of tether 60 urges the back end of shaft 54 into contact with, and compresses, coil spring 46. Upon release of tether 60, the bias of coil spring 46 propels projectile out of bore 42. Tether 60 may be repeatedly pulled and released to rearm and fire weapon 32 in a repetitive manner. During the course of play, the child may return the weapon from the lowered firing ready position to the raised positin by manually pivoting arm 24.

Another embodiment of the toy projectile propelling attachment of the present invention is illustrated in FIGS. 6–9, on a toy figure 70 of a conventional construction. The toy figure should have an arm 71 with a shoulder 72 adjacent which the arm is connected to a torso 73 for pivotal movement relative to the torso about an axis 74. Opposite the pivotally connected shoulder end, arm 71 has a partially closed, grasping hand 75.

Removably mountable on figure 70 is a projectile propelling attachment 80, in the form of a bazooka 82 having a forward firing end 83 and a back end 84. Depending from the bottom of the bazooka is a handle 85 plus a mounting harness 86 which includes a generally horseshoe shaped clip 88 with a laterally and downwardly angling projection 90. Clip 88 fits over the shoulder of figure 70 with projection 90 extending inwardly across the back of the figure.

On the inside of bazooka 82 there is, as in weapon 32, a blind bore 42 extending in from firing end 83. At the back end of bore 42 there is a smaller diameter bore 44 extending out through back end 84. Bazooka 82 has another bore 92, larger than bore 42, extending part way in from the firing end in order to receive the entire length of rocket projectile 50. Within bore 42, a coil spring 46 is secured with which a projectile 50 and string tether 60 cooperate in the same manner as previously described with respect to weapon 32. Except that projectile 50 seats entirely within the bazooka, operation of bazooka 82 is otherwise similar to that of weapon 32.

Figure 6:
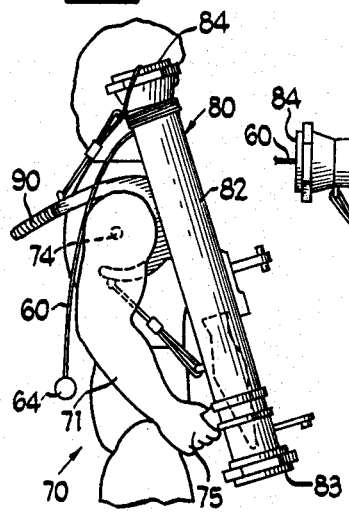
FIG. 6 is a side elevational view of another embodiment of the present invention.
Figure 7:
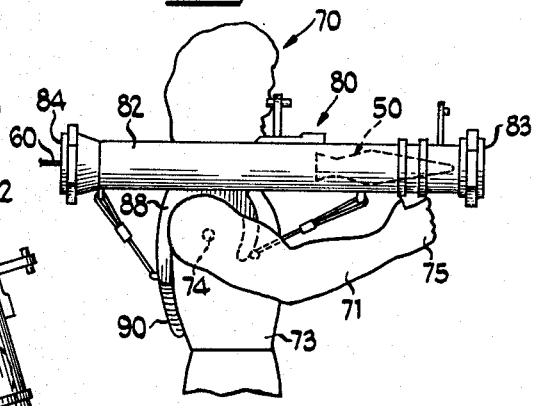
FIG. 7 is a side elevational view of the embodiment shown in FIG. 6 with the projectile propelling attachment moved to a firing position.
Figure 8:
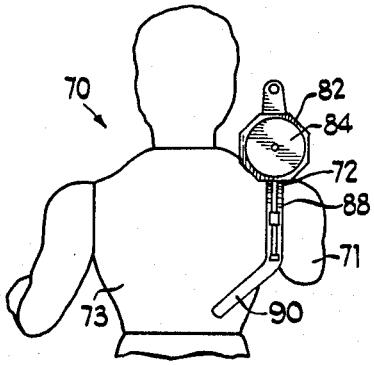
FIG. 8 is a rear elevational view of the position shown in FIG. 7.
Figure 9:
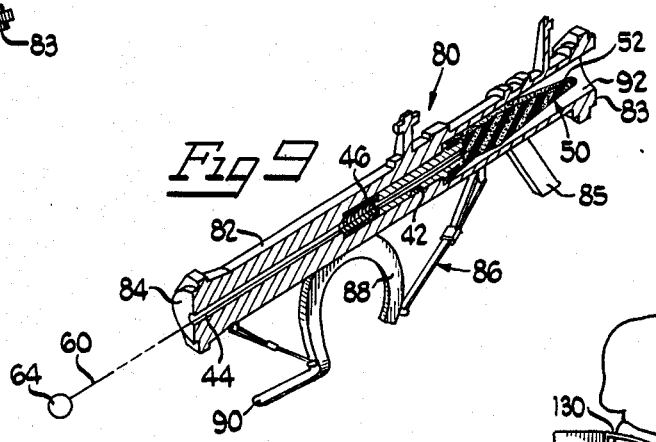
FIG. 9 is an enlarged perspective view of a vertical section of the projectile propelling attachment shown in FIGS. 6, 7 and 8.
Figure 10:
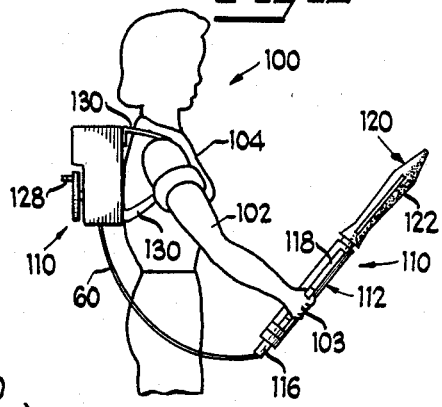
FIG. 10 is a side elevational view of yet another embodiment of the present invention.
Figure 12:
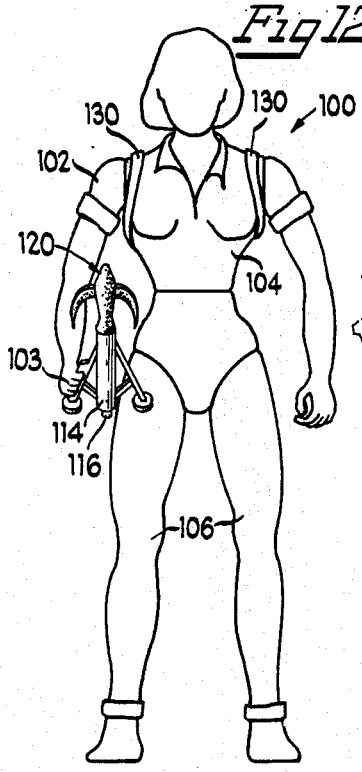
FIG. 12 is a front plan view.
Figure 11:
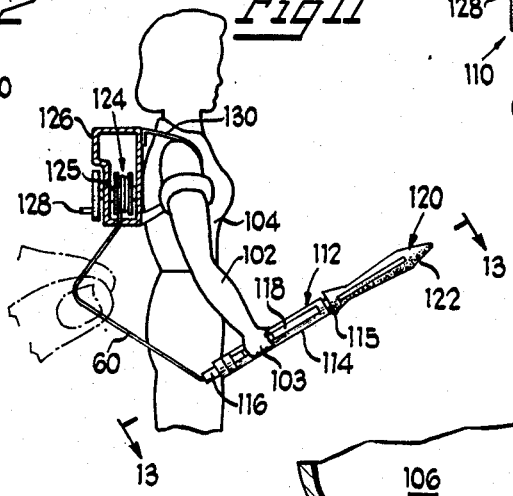
FIG. 11 is a side elevational view similar to FIG. 10, but showing the projectile propelling attachment in a firing position.
Figure 13:
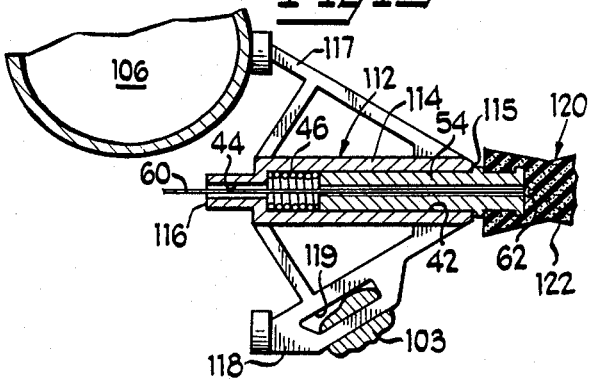
FIG. 13 is an enlarged sectional view taken generally along line 13—13 of FIG. 11.

As will be noted from the comparison of FIG. 6 with FIGS. 1 and 2, the first, nonfiring, position of attachment 80 is with the arm in a lowered, rather than a raised position. Accordingly, after projectile 50 is seated within bore 92, pulling on tether 60 will pivot arm 71 up approximately ninety degrees to the extended firing ready position illustrated in FIGS. 7 and 8. With arm 71 in the extended, generally horizontal firming position, projection 90 abuts the back of FIG. 20 to restrain attachment 80 during further pulling of tether 60 to compress coil spring 46. When firing ceases, rocket projectile 50 may be stored within bazooka 82 by wrapping part of tether 60 around the bazooka adjacent the back end as shown in FIG. 6.

FIGS. 10–13 show yet another embodiment of the present invention, in which a FIG. 100 has an arm 102 connected to a torso 104 for pivotal movement. Arm 102 has a hand 103 in a partially closed or grasping position. Figure 100 also includes a pair of legs 106 attached to the lower end of torso 104. A projectile propelling attachment 110 includes a launcher apparatus 112. The launcher has a principal, central portion 114 with a front firing end 115 and a back end 116. Extending outwardly from portion 114 are an angular inner brace 117 and outer brace 118. On the outside of the outer brace there is a handle opening 119 into which hand 103 is fitted to mount launcher 112 on the figure.

As with the previously described weapon 32, launcher 112 includes bores 42 and 44 plus coil spring 46. Insertable in bore 42 is shaft 54 of a projectile 120 having a grappling hook nose 122 made of a soft, resilient material. A string tether 60, like that of the previous embodiments, is attached at one end 62 to projectile 120. The opposite end of the string is secured to a reel 124 that is mounted for rotation on an axle 125 carried by a backpack 126. Coaxially mounted on a portion of axle 125 that extends outside of backpack 126, for rotation with the axle, is a crank 128. Backpack 126 is mounted on FIG. 100 by shoulder straps 130.

Initial operation of attachment 110 is similar to that previously described for attachments 30 and 80. Once projectile 120 is engaged within bore 42 of launcher 112, additional pulling on tether 60 will move arm 102 downwardly until brace 117 abuts one of the legs 106. Further pulling of tether 60 will then compress spring 46 and upon release of the string, the bias of the spring projects the grappling hook toward a target. Manual rotation of crank 128 will then wind tether 60 about reel 124 to retract the grappling hook projectile.

While particular embodiments have been shown and described with some alternatives and variations, further changes and modifications will occur to those skilled in the art. It is intended in the appended claims to cover all such alternatives, variations, changes and modifications as fall within the true spirit and scope of the present invention.

What is claimed as new and desired to be secured by Letters Patent is:

1. A toy projectile propelling attachment comprising:

an apparatus including a barrel having a bore extending through the barrel;

spring biasing means contained within the barrel;

a projectile;

the barrel receiving and seating at least a portion of the projectile;

the tether having a forward end and a rearward end;

the forward end of the tether secured to the projectile; and the rearward end of the tether extending through the apparatus so that pulling on the rearward end of the tether engages the biasing means with the projectile and releasing the tether propels the projectile completely outside the confines of the barrel vehicle while retaining the spring biasing means within the barrel.

2. The toy projectile propelling attachment of claim 1 including means securing the spring inside the bore.

3. The toy projectile propelling attachment of claim 2 in which an end of the spring distal from the projectile has an enlarged outer diameter that is generally equal to the diameter of the bore so that the spring is retained by friction within the bore.

4. The toy projectile propelling attachment of claim 2 in which an end of the spring distal from the projectile is anchored within the barrel.

5. A toy projectile propelling attachment in combination with a toy figure having a torso with an arm connected at one end to the torso comprising:

an apparatus including biasing means;

a projectile;

a tether having a forward end and a rearward end;

the forward end of the tether secured to the projectile;

the rearward end of the tether extending through the apparatus;

means mounting the apparatus on the figure so that an operator pulling on the rearward end of the tether engages the biasing means with the projectile and upon releasing the tether propels the projectile;

the toy figure having the arm connected at one end to the torso for pivotal movement relative to the torso between a first position and a second position in which the mounting means engages the arm so that once the projectile is in contact with the apparatus, pulling on the rearward end of the tether moves the arm from the first position to the second position;

the apparatus including a piece with a front end and a back end;

a bore extending through the piece from front to back;

the bore having a reduced cross section adjacent the back end;

the bias being positioned in the bore between the front end and the reduced cross section;

the bore having an axis;

the piece including a projection extending outwardly at an angle to the axis; and the projection abutting a part of the figure upon moving the arm from the first position to the second position.

6. The toy projectile propelling attachment of claim 5 in which the projection extends generally transverse to the axis.

7. A toy projectile propelling attachment in combination with a toy figure having a torso with an arm connected at one end to the torso, the attachment comprising:

an apparatus including biasing means;

a projectile;

a tether having a forward end and a rearward end;

the forward end of the tether secured to the projectile;

the rearward end of the tether extending through the apparatus;

means mounting the apparatus on the figure so that an operator pulling on the rearward end of the tether engages the biasing means with the projectile and upon releasing the tether propels the projectile; and the means mounting the apparatus including a generally horseshoe shaped clip that fits over the toy figure proximate the connection of the one end of the arm to the torso.

8. The toy projectile propelling attachment of claim 7 for a toy figure having the arm connected at one end to the torso for pivotal movement relative to the torso between a first position and a second position in which the mounting means engages the arm so that once the projectile is in contact with the apparatus, pulling on the rearward end of the tether moves the arm from the first position to the second position.

9. The toy projectile propelling attachment of claim 8 in which one end of the generally horseshoe shaped clip forms a projection that abuts a part of the figure upon moving the arm from the first position to the second position.

* * * * *